US011582846B1

(12) United States Patent
Wang

(10) Patent No.: US 11,582,846 B1
(45) Date of Patent: Feb. 14, 2023

(54) DIMMING CONTROL DEVICE

(71) Applicant: Tiejun Wang, Lin'an (CN)

(72) Inventor: Tiejun Wang, Lin'an (CN)

( * ) Notice: Subject to any disclaimer, the term of this patent is extended or adjusted under 35 U.S.C. 154(b) by 0 days.

(21) Appl. No.: 17/542,829

(22) Filed: Dec. 6, 2021

(51) Int. Cl.
*H05B 45/20* (2020.01)
*H05B 47/19* (2020.01)
*H05B 47/195* (2020.01)

(52) U.S. Cl.
CPC ..... *H05B 45/20* (2020.01); *H05B 47/19* (2020.01); *H05B 47/195* (2020.01)

(58) Field of Classification Search
None
See application file for complete search history.

(56) References Cited

U.S. PATENT DOCUMENTS

2014/0265880 A1* 9/2014 Taipale ..... H05B 45/12 315/246
2018/0103518 A1* 4/2018 Janik ..... H05B 45/24
2018/0177016 A1* 6/2018 Sooch ..... H05B 47/19

FOREIGN PATENT DOCUMENTS

CN 106102247 A * 11/2016 ..... H05B 33/0809

* cited by examiner

*Primary Examiner* — Dedei K Hammond
(74) *Attorney, Agent, or Firm* — Daniel M. Cohn; Howard M. Cohn

(57) ABSTRACT

Disclosed embodiments provide a lighting controller and illumination system. A controller may include a phase-cut dimmer, a lighting receiver module, and at least two banks of lights. In embodiments, the lights may be LED (light emitting diode) lights, and the lighting receiver module is an LED driver. A first bank of lights illuminates at a first CCT and a second bank of lights illuminates at a second CCT. The controller communicates encoded information on a carrier signal that is received by the lighting receiver module. The lighting receiver module decodes the received encoded information and adjusts the intensity of the first and second bank of lights to create a combined CCT. The combined CCT may be realized by a combination of light from the first bank of lights and light from the second bank of lights. The combined CCT may be representative of a specified CCT.

20 Claims, 5 Drawing Sheets

DIMMER INPUT

DIMMER OUTPUT

DIMMER OUTPUT

DIMMER OUTPUT

DIMMING CONTROL DEVICE

FIELD

The present invention relates generally to lighting control, and more particularly to a dimming control device.

BACKGROUND

Color temperature defines the color appearance of a white LED. CCT is defined in degrees Kelvin; a warm light is around 2700K, moving to neutral white at around 4000K, and to cool white, at 5000K or more. Since it is a single number, CCT is simpler to communicate than chromaticity or SPD, leading the lighting industry to accept CCT as a shorthand means of reporting the color appearance of "white" light emitted from electric light sources.

Phase-cut dimmers are the most common dimming control and are often referred to as TRIAC dimmers. A phase-cut light dimmer is used to adjust power that is supplied to a lamp in order to adjust the brightness (amount of light) emitted by the lamp. Phase-cut dimmers modify an alternating current (AC) signal that is input to a lighting device by "cutting" or removing some portion of the sinusoidal waveform phase, which reduces the root-mean-square (RMS) voltage of the waveform. An incandescent lamp's illumination is based on thermal radiation. Therefore, both output brightness and correlated color temperature (CCT) of an incandescent lamp's emitted light is a positive function of the lamp's input power, in that both brightness and CCT increase with increasing input power and decreases with decreasing power.

Lighting plays an important role in the design and usability of interior spaces. Different situations may call for different lighting conditions. For example. the ideal lighting for use while preparing a meal in the kitchen may be different from the ideal lighting for watching a movie after dinner. It is therefore desirable to have improvements in lighting control.

SUMMARY

In one aspect, there is provided an apparatus comprising: a dimmer, configured and disposed to control a carrier signal, wherein the carrier signal is superimposed on an alternating current signal associated with a power source; a user interface, configured and disposed to receive a specified correlated color temperature (CCT) value; and a modulator, the modulator configured and disposed to encode the specified CCT value on the carrier signal, wherein the apparatus is configured to provide power to: a first light-emitting device that is configured to emit a first white light of a first correlated color temperature (CCT); and a second light-emitting device that is configured to emit a second white light of a second CCT that is lower than the first CCT, for the first white light to mix with the second white light to yield a combined white light having a combined-light CCT that corresponds to the specified CCT value.

In another aspect, there is provided an apparatus comprising: a dimmer, configured and disposed to control a carrier signal, wherein the carrier signal comprises an alternating current signal; a communication interface, configured and disposed to receive a specified CCT value; a modulator, the modulator configured and disposed to encode the specified CCT value on the carrier signal, wherein the apparatus is configured to provide power to: a first light-emitting device that is configured to emit a first white light of a first correlated color temperature (CCT); and a second light-emitting device that is configured to emit a second white light of a second CCT that is lower than the first CCT, for the first white light to mix with the second white light to yield a combined white light having a combined-light CCT that corresponds to the specified CCT value.

In yet another aspect, there is provided an illumination system, comprising: a controller; a driver, the driver configured and disposed to receive input from the controller; a first light-emitting device coupled to the driver; a second light-emitting device coupled to the driver, wherein: the first light-emitting device is configured to emit light having a CCT in a range of 4000K to 10000K; the second light-emitting device is configured to emit light having a CCT in a range of 1500 to 4000K; the controller comprises: a dimmer, configured and disposed to control a carrier signal, wherein the carrier signal comprises an alternating current signal; a communication interface, configured and disposed to receive a specified CCT value; and a modulator, the modulator configured and disposed to encode the specified CCT value on the carrier signal, and transmit the specified CCT value to the driver.

BRIEF DESCRIPTION OF THE DRAWINGS

The structure, operation, and advantages of the present invention will become further apparent upon consideration of the following description taken in conjunction with the accompanying figures (FIGs). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

Figure 1:
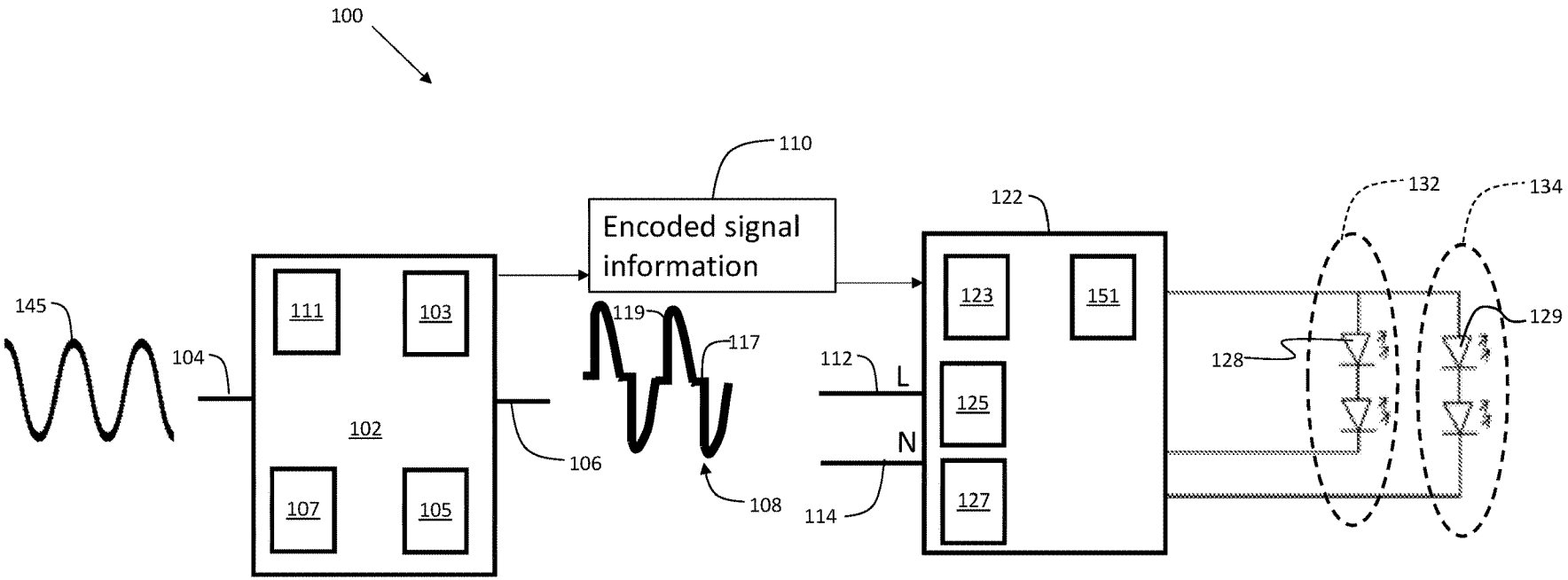

Often, similar elements may be referred to by similar numbers in various figures (FIGs) of the drawing, in which case typically the last two significant digits may be the same, the most significant digit being the number of the drawing figure (FIG). Furthermore, for clarity, some reference numbers may be omitted in certain drawings.

FIG. 1 shows a block diagram of a system in accordance with embodiments of the present invention.

Figure 2:
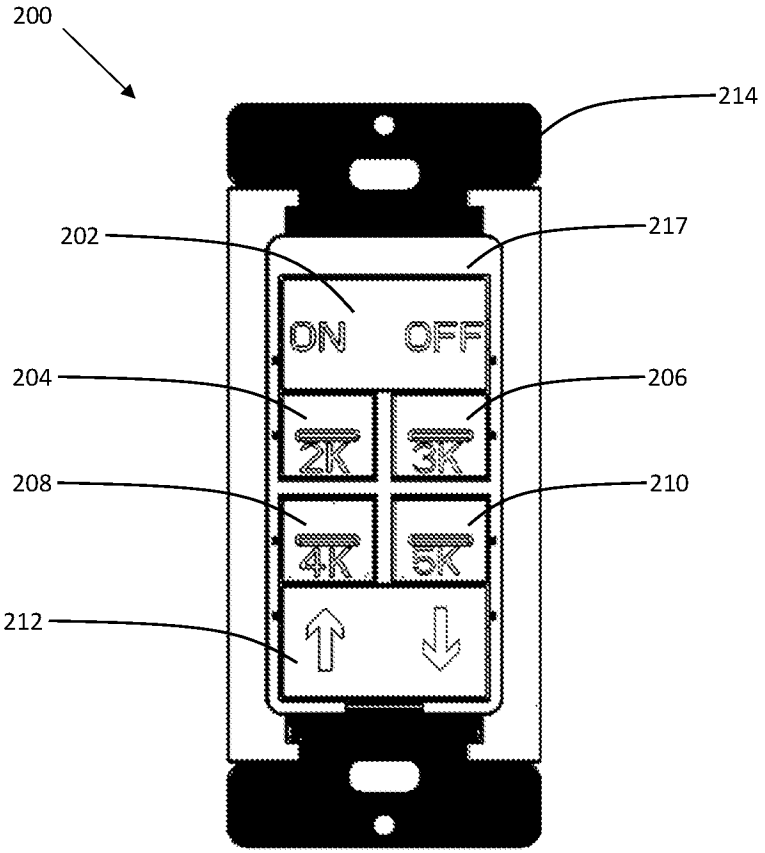

FIG. 2 shows a controller in accordance with embodiments of the present invention.

Figure 3:
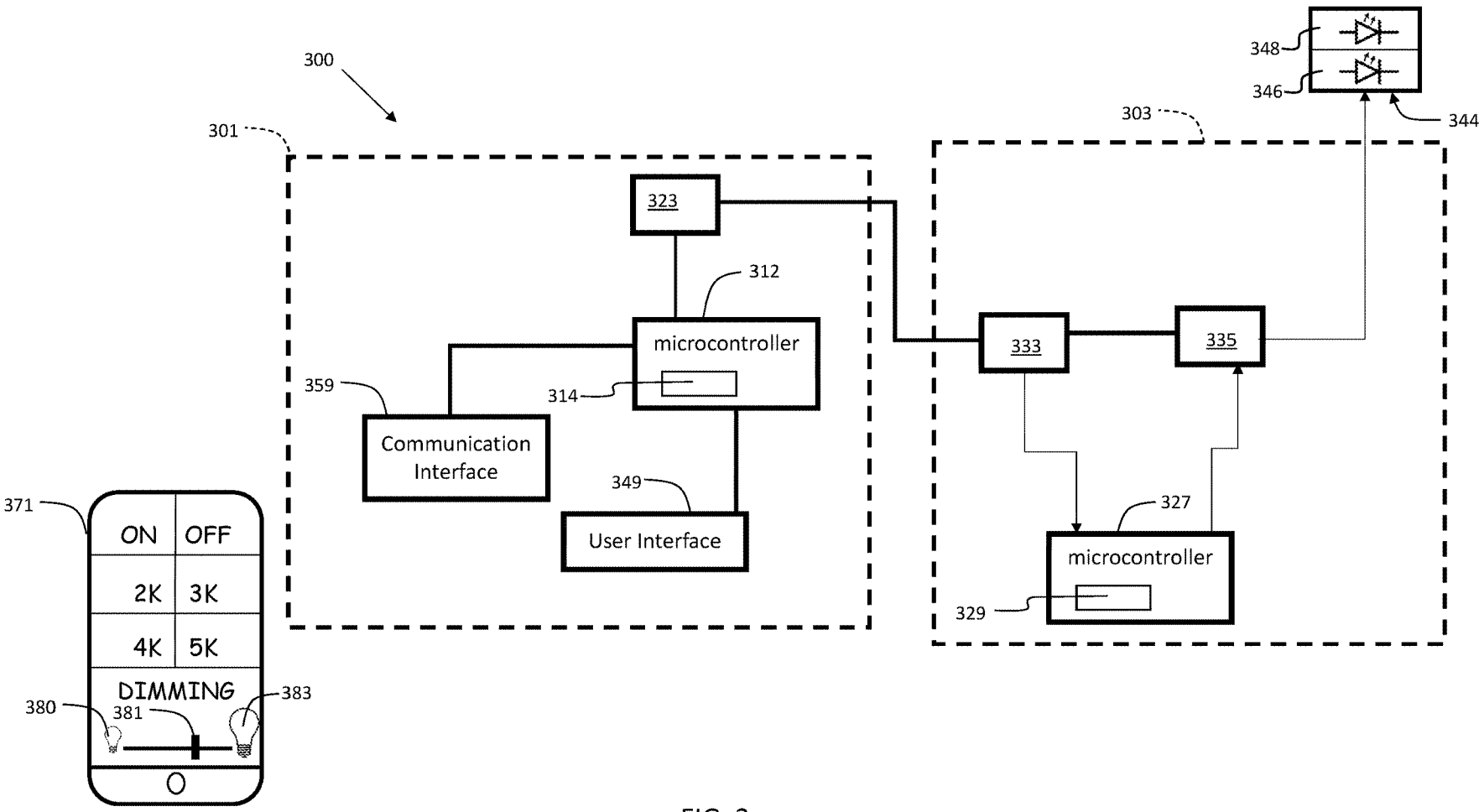

FIG. 3 shows a block diagram of an additional embodiment of the present invention.

Figure 4:
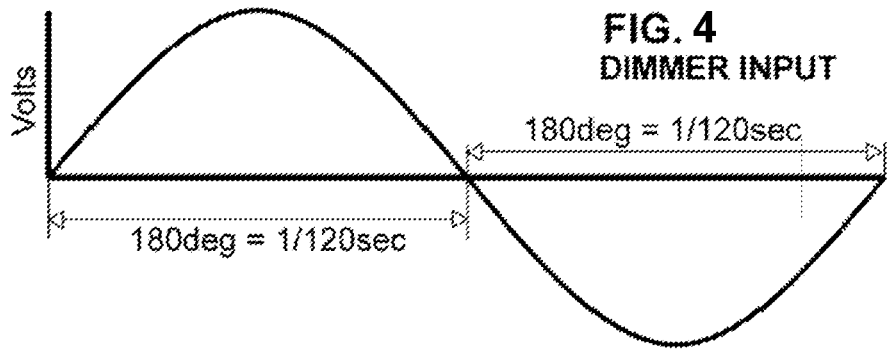

FIG. 4 is a graph of voltage versus time of an example single cycle of mains supply power that a dimmer might receive as input.

Figure 5:
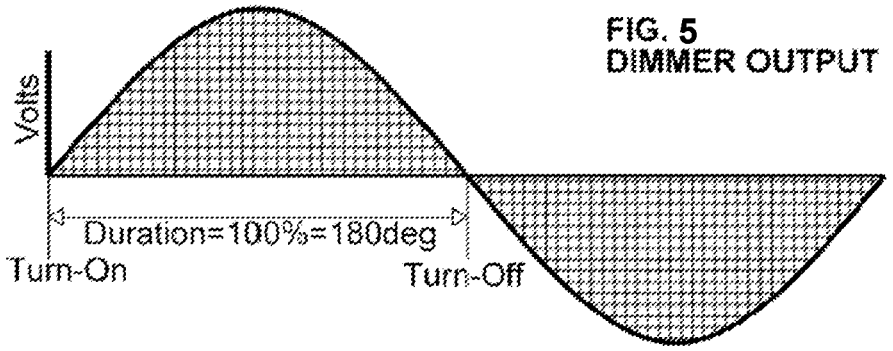
Figure 6:
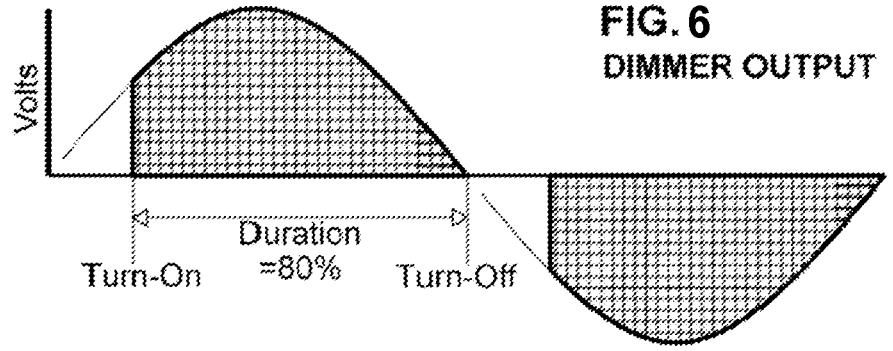
Figure 7:
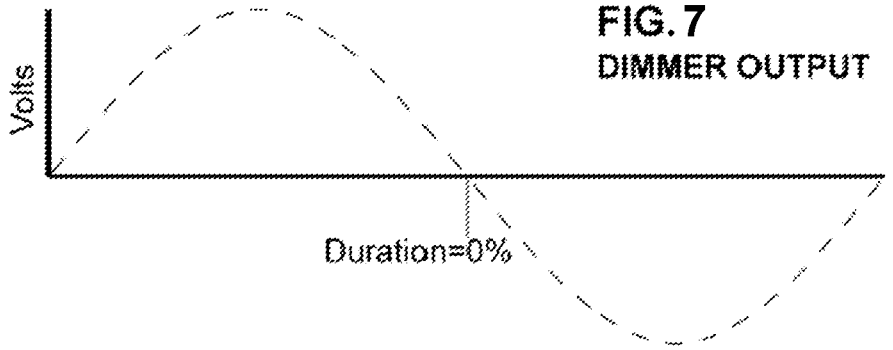

FIGS. 5-7 are example voltage traces of input supply power that the dimmer might output to a controller.

Figure 8:
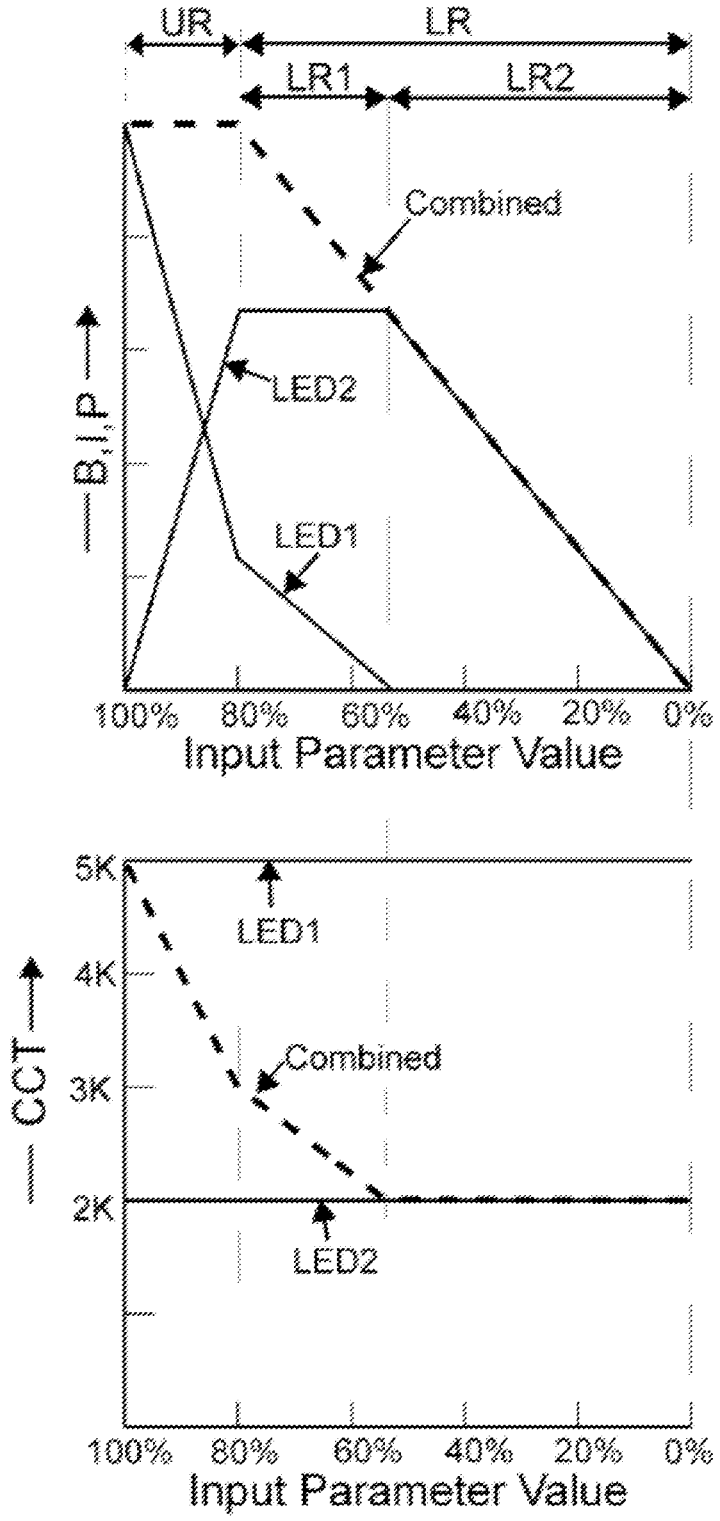

FIG. 8 provides an example of a power-distribution scheme.

DETAILED DESCRIPTION

Disclosed embodiments provide a lighting controller and illumination system. A controller may include a phase-cut dimmer, a lighting receiver module, and at least two banks of lights. In embodiments, the lights may be LED (light emitting diode) lights, and the lighting receiver module includes an LED driver. The LED driver carefully controls the current delivered to the LED light-emitting devices. A first bank of lights illuminates at a first CCT and a second bank of lights illuminates at a second CCT. The controller communicates encoded information on a carrier signal that is received by the lighting receiver module. The lighting receiver module decodes the received encoded information and adjusts the intensity (brightness) of the first and second bank of lights to create a combined CCT. The combined CCT may be realized by a combination of light from the first bank of lights and light from the second bank of lights. The combined CCT may be representative of a specified CCT. Thus, embodiments produce a combined white light having a combined-light CCT that corresponds to the specified CCT, in that the combined-light CCT substantially matches the specified CCT. In embodiments, the combined-light CCT is within +/−10 percent of the specified CCT value.

FIG. 1 shows a block diagram of a system 100 in accordance with embodiments of the present invention. Controller 102 includes a dimmer 111. In some embodiments, the dimmer includes a leading-edge phase-cut dimmer. In other embodiments, the dimmer includes a trailing-edge phase-cut dimmer. Controller 102 may also include a local user interface 107. The local user interface 107 may include one or more buttons, switches, sliders, knobs, and/or other suitable controls for adjusting lighting parameters. The lighting parameters can include, but are not limited to, selection of a specified CCT, a dimming/brightness selection, and/or other lighting parameters.

The controller 102 may further include a communication interface 105. The communication interface may include a radio frequency signal RF receiver or transceiver. The communication interface may include a Bluetooth® transceiver, Zigbee transceiver, and/or infrared (IR) receiver to allow lighting control from a remote device. In embodiments, the remote device may be a smart phone, tablet computer, wearable computer, and/or other suitable computing device. In some embodiments, the remote device may be an infrared remote-control device. In embodiments, the remote device transmits a message to the controller 102. The message may include a specified CCT value, an ON/OFF status, and/or a specified brightness value. Embodiments may further include a data modulator 103. The data modulator 103 may encode signal information 110, which may include lighting parameters, onto a carrier signal, such as a 60 Hz alternating current (AC) signal. In embodiments, the data modulator 103 performs phase-cut encoding. In some embodiments, a cut portion of a signal can represent a logical 0, while a non-cut portion can represent a logical 1. These two states can be used to encoding lighting parameter information. In embodiments, the carrier signal is superimposed on the AC signal of the power grid (source) that is used to power the lights.

An AC input signal 145 is applied to the controller at input 104. An AC output signal 108 is output from the controller at output 106. The AC output signal 108 is a phase-cut encoded output of the input signal 145, which can serve as a signal carrier. In embodiments, a cut portion, indicated generally as 117, of the waveform represents a logical 0, and a non-cut portion, indicated generally as 119 can represent a logical 1. The two binary states can be used for encoding lighting parameters. In embodiments, the output signal 108 serves as a carrier signal for encoded information from the controller 102 to the lighting receiver module 122. The encoded information can include a specified CCT value. In embodiments, the specified CCT value can range from 1000K to 10000K, where "K" refers to color temperature in Kelvin (K).

The system 100 includes a lighting receiver module 122. The lighting receiver module 112 may include two inputs to receive signal 108: L ("Line"—indicated as reference 112), and N ("Neutral"—indicated as reference 114). The receiver module 122 can include various circuits, processors, and/or other electronic components to perform various lighting adjustments, including setting of a CCT, and a dimness/brightness setting. The lighting receiver module 122 may include an AC/DC conversion circuit 125 to convert an AC signal to a direct current (DC) signal. The lighting receiver module 122 may include a microcontroller 151 configured and disposed to receive and act on data transmitted in the encoded signal information 110. The lighting receiver module 122 may include a data demodulator 123 to retrieve data from the encoded signal information 110. The lighting receiver module 122 may further include a control circuit 127 which applies the retrieved data from the encoded signal information to two light-emitting devices, indicated as 132 and 134. The data demodulator 123 and the control circuit 127 may be coupled to the microcontroller 151.

In embodiments, each light-emitting device is comprised of a plurality of LEDs. Light-emitting device 132 is comprised of multiple LEDs, indicated generally as 128. Light-emitting device 134 is comprised of multiple LEDs, indicated generally as 129. In embodiments, the LEDs of light-emitting device 132 are of a first CCT, and the LEDs of light emitting device 134 are of a second CCT. By combining different amounts of light from light emitting device 132 and light emitting device 134, a combined CCT can be achieved, that may range from a low limit to a high limit. In some embodiments, the low limit ranges from 1000K to 2000K, and the high limit ranges from 5000K to 10000K.

In some embodiments, the encoded signal information 110 may include a data tuple that contains a percentage value for the first light emitting device 132 and a percentage value for the second light emitting device. As an example, a data tuple of (100, 75) can indicate that the first light emitting device 132 is operated at maximum brightness, and the second light emitting device 134 is operated at 75 percent brightness. In embodiments, the control circuit 127 may adjust the brightness of light emitting devices by adjusting DC current/voltage levels supplied to the light emitting devices 132 and 134 based on the encoded signal information 110, in order to create a specified CCT. Thus, light from the light-emitting device 132 and light from the light-emitting device 132 mix to yield a combined white light having a combined CCT with a combined brightness. Note that while two light-emitting devices (132 and 134) are shown in FIG. 1. Some embodiments may have more than two light-emitting devices.

FIG. 2 shows a controller 200 in accordance with embodiments of the present invention that can be used to control light-emitting devices. Controller 200 comprises an enclosure 217 that encloses various internal components. Controller 200 may further comprise an on-off switch 202 that can be used to set a light-emitting device on or off. Controller 200 may further comprise a dimmer control 212 that can be used to adjust the brightness of light-emitting devices. Controller 200 may further include a plurality of CCT buttons to set a specified CCT value. Controller 200 includes button 204, for specifying a CCT value of 2000K (shown as "2K" on the button to conserve space). Controller 200 includes button 206, for specifying a CCT value of 3000K (shown as "3K" on the button to conserve space). Controller 200 includes button 208, for specifying a CCT value of 4000K (shown as "4K" on the button to conserve space). Controller 200 includes button 210, for specifying a CCT value of 5000K (shown as "5K" on the button to conserve space). Thus, in embodiments, the user interface comprises a plurality of preset CCT value buttons. The controller 200 may further include a wall-mount bracket 214 which is configured and disposed to secure the controller 200 to a wall. In some embodiments, the controller 200 may be configured and disposed to fit within a standard single-gang box that is commonly used for light switches.

In embodiments, light having the specified CCT value may be obtained by combining the light from multiple light-emitting devices at various levels. By mixing light of different CCT values, a new combined CCT value is achieved. As an example, mixing a first light source of 1000K CCT with a second light source of 5000K CCT can result in a combined CCT light source, where the combined CCT value is in between the first light source CCT value and the second light source CCT value. Continuing with the example, the combined CCT may have a value ranging from 1000K to 5000K, depending on the amount of light contributed by each light source. To achieve a particular combined CCT value, the brightness of each light source may be adjusted. In some embodiments, a lookup table may be stored in a non-transitory computer-readable medium that contains recipes for a particular combined CCT value. As an example, an entry in the lookup table for a particular combined CCT value may include a first brightness level for a first light-emitting device, and a second brightness level for a second light-emitting device. When a user indicates a specified CCT though a user interface such as a button or slider control, the controller 200 can transmit lookup table data to the lighting receiver module (122 of FIG. 1). The lighting receiver module 122 can then adjust the light sources accordingly to create the specified CCT as a combined CCT from a mix of light-emitting devices. Thus, in embodiments, first and second white lights mix to yield a combined white light having a combined CCT with a combined brightness. In some embodiments, more than two light-emitting sources may be used. For example, some embodiments may utilize four light-emitting devices. In such embodiments, the first light-emitting device may have a CCT value of 1000K, the second light-emitting device may have a CCT value of 3000K, the third light-emitting device may have a CCT value of 5000K, and the fourth light-emitting device may have a CCT value of 10000K. Using various combinations of light from these four devices allows for creation of multiple combined CCT values. This provides users with flexible lighting solutions that can accommodate various situations and user-preferences.

FIG. 3 shows a block diagram 300 of an additional embodiment of the present invention. Block diagram 300 includes a controller 301, coupled to a lighting receiver module 303. Controller 301 includes a microcontroller 312, which comprises non-transitory computer-readable memory 314 that contains instructions, that when executed by the microcontroller 312, implement one or more parts of disclosed embodiments. In embodiments, memory 314 may include flash memory, static random-access memory (SRAM), or other suitable memory type. The controller 301 may include a user interface 349 which comprises multiple buttons, switches, and/or knobs to control the brightness and/or CCT of light-emitting devices. The controller 301 may further include a communication interface 359. The communication interface 359 may include a Bluetooth®, Wi-Fi, Zigbee, and/or other suitable interface. The communication interface may include an infrared receiver. The communication interface 359 enables a mobile electronic computing device 371 to communicate with the controller 301. An application (app) executing on the computing device 371 may render a user interface that can include an ON button, an OFF button, as well as preset CCT values (indicated as 2K for a 2000K CCT, 3K for a 3000K CCT, 4K for a 4000K CCT, and 5K for a 5000K CCT). The app may also provide an adjustable dimming control 381 that can be moved from a maximum brightness 383 to a minimum brightness 380 to adjust the brightness. Output circuit 323 may include a TRIAC dimmer, and data modulator in order to send CCT information via a carrier signal, such as an AC signal.

The lighting receiver module 303 receives electrical supply power in the form of segments of power. The lighting receiver module 303 supplies power to a light fixture 344 that comprises a first light-emitting device 346 and a second light-emitting device 348. In some embodiments, the lighting receiver module 303 and light fixture 344 may be housed within a unified enclosure. In embodiments, the lighting receiver module 303 distributes (apportions) the input supply power to the first and second light-emitting devices 346 and 348 according to a power-distribution scheme. In embodiments, the light control circuit 335 within the lighting receiver module 303 performs some or all of the power distribution scheme. Inside the lighting receiver module 303, there is a data demodulator 333 to retrieve data from the encoded signal information. In embodiments, the lighting receiver module 303 distributes the supply power to the first and second light-emitting devices according to a power-distribution scheme that differentiates between whether segment duration of the segments is in an upper range or a lower range, as follows: (i) In the upper range: as segment duration decreases, combined-light CCT decreases and combined-light brightness remains constant. (ii) In the lower range: as the segment duration decreases, combined-light brightness decreases. In embodiments, this can be based on the received signal information that is decoded. In embodiments, a microcontroller 327 executes instructions stored in non-transitory computer-readable medium 329, which may include flash memory, static random-access memory (SRAM), or other suitable memory type. The light control circuit 335 may be configured by the microcontroller 327 using retrieved data from the encoded signal information. In embodiments, the light control circuit 335 is configured to adjust the distribution ratio of the two light-emitting devices according to the parameters of the carrier signal. In embodiments, the light control circuit 335 includes various components, including, but not limited to, LED driver circuits, voltage dividers, comparator/phase-determiners, power control circuits, AC/DC conversion circuits, and DC voltage conversion circuits. One or more of the aforementioned components may be configurable by the microcontroller 327 via registers, input/output (IO) signals, or other suitable mechanisms.

In yet other embodiments, the first CCT might be in the range 4000K to 7000K. The second CCT might be in the range 1500K to 3000K. The combined-light CCT might be: in the range 4500K to 6500K when the segment duration is at a top of the upper range, in the range 2500K to 3500K when the segment duration is at the bottom of the upper range and the top of the lower range, and in the range 1500K to 2500K when the segment duration is at a bottom of the lower range.

FIG. 4 shows a graph of voltage versus time of an example of a single cycle of mains supply power. The cycle corresponds to 360 degrees (deg) and lasts 1/60 second (sec). Accordingly, each half cycle of input voltage/current corresponds to 180 deg and has a duration of 1/120 sec.

FIGS. 5-7 illustrate examples of different voltage traces of supply power that the dimmer 111 (FIG. 1) is configured to output. The dimmer 111 (FIG. 1) outputs only a segment of each half-cycle of the AC mains supply. Each output segment ends at, or substantially at, the end of the half-cycle (labelled "Turn-Off" in the figures) when the TRIAC turns off, which corresponds to 180 deg. Each output segment starts at a point in time (labelled "Turn-On" in the figures) when the TRIAC turns on. The Turn-On point is located at a point within the half-cycle, correlating to a cycle-angle between 0 deg and 180 deg, that is selected (controlled) by the user through the user-interface component position (e.g. position of adjustable dimming control 381).

FIG. 5 shows an example in which the user-interface component position (e.g. position of adjustable dimming control 381) is at the first end of the operational full-scale range. This causes the TRIAC's Turn-On point, and thus the output segment's starting point, to be about 0 deg. So, the output segment's duration is about 180 deg, which corresponds to 100% of the half-cycle and about 1/120 sec.

FIG. 6 shows an example in which the user-interface component position (e.g. position of adjustable dimming control 381) is at an intermediate position about 80% of the way from the second end of the full-scale range to the first end of the full-scale range. This causes the TRIAC's Turn-On point to be about 20% of the way through the 180 deg half-cycle. So, the TRIAC is on for a duration of only 80% of the 180 deg half-cycle, corresponding to 1/150 sec (which is 80% of the 1/120 sec half-cycle).

FIG. 7 shows an example in which the user-interface component position (e.g. position of adjustable dimming control 381) is at the second end of the full-scale range. This causes the TRIAC's Turn-On point to be at the end of the half-cycle which coincides with the Turn-Off point, so that the output segment's duration is about 0 deg and about 0 sec. Effectively, the lamps are off during this condition, and not emitting any light.

As shown in FIGS. 5-7, the output segment's duration (in terms of time in seconds or cycle-angle in degrees) is a function of the user-interface component's value. And the user-interface component's value corresponds to the component's position (e.g. position of adjustable dimming control 381) or number-of-bars-lit or displayed number. As the user-interface component's position progresses from the first end, through the full-scale range, to the second end, the output supply's segment duration progresses from 180 deg down to 0 deg and from 1/120 sec down to 0 sec. Conversely, as the user-interface component's position progresses from the second end, through the full-scale range, to the first end, the dimmer's supply's segment duration progresses from 0 deg up to 180 deg and from 0 sec up to 1/120 sec. In this example, the segment duration is continuously-variable, and the position of the user-interface component position (e.g. position of adjustable dimming control 381) is continuously-variable, for the segment duration to be a smoothly-continuous monotonic function of the user-interface component's position.

FIG. 8 provides an example of the power-distribution scheme. FIG. 8 includes graphs that illustrate an example of how brightness (B), current (I), power (P), and correlated-color temperature (CCT) might be a function of a characteristic (in this example segment duration) of the input supply power. In the present examples, B, I, and P, are proportional to each other, so that a single graph in FIG. 8 suffices to characterize all of them. All percentages in the X-axes of FIG. 8 are in terms of a half-cycle of the input supply power. So, for example, a segment duration of 100% means the segment lasts the entire half-cycle—i.e., a full 180 deg. Referring again to FIG. 3, the curve indicated "LED1" may refer to light-emitting device 346, and the curve indicated "LED2" may refer to light-emitting device 348.

The power-distribution scheme is explained below with reference to the following terms: brightness values emitted by the first and second light-emitting devices 346, 348 are respectively called first brightness and second brightness. Brightness of the combined light is called combined brightness. Electrical current and power that are supplied by the light control circuit 335 to the first light-emitting device 346 are respectively called first current and first power. Electrical current and power supplied by the light control circuit 335 to the second light-emitting device 348 are respectively called second current and second power. The sum of the electrical currents and the sum of the electrical powers supplied by the light control circuit 335 to both the first and second light-emitting devices 346, 348 are respectively called combined current and combined power.

The lighting receiver module 303 receives input supply power from the dimmer 111 (FIG. 1). The lighting receiver module 303 might determine whether a characteristic of the input supply power—in the example segment duration—is in an upper range (UR) or a lower range (LR) and, further, whether the characteristic is in an upper portion of the lower range (LR1) or in a lower portion (LR2) of the lower range (LR). In the example of FIG. 8, UR extends from 100% down to 80%, LR extends from 80% down to 0%, LR1 extends from 80% to about 55%, and LR2 extends from about 55% down to 0%. Where the above percentages are in terms of operational full-scale of the input parameter (which in this example is segment duration).

If/when the segment duration is in the upper range (UR), as segment duration decreases: (A1) the combined CCT decreases and the combined brightness remains constant; and/or (A2) the first current decreases, the second current increases, and the combined current remains constant; and/or (A3) the first power decreases, the second power increases, and the combined power remains constant.

If/when segment duration is in the lower range (LR), as segment duration decreases: (B1) the combined brightness decreases; and/or (B2) the combined current decreases; and/or (B3) the combined power decreases.

If/when segment duration is in the upper portion (LR1) of the lower range, as segment duration decreases: (C1) the first brightness decreases, the second brightness remains constant, and the combined CCT decreases; and/or (C2) the first current decreases, and the second current remains constant; and/or (C3) the first power decreases, and the second power remains constant.

If/when segment duration is in the lower portion (LR2) of the lower range, as segment duration decreases: (D1) the first brightness remains constant (in this example zero), the second brightness decreases, and the combined CCT remains constant; and/or (D2) the first current remains constant, and the second current decreases; and/or (D3) the first power remains constant, and the second power decreases.

The above example scheme includes steps in which a parameter "remains constant". In a related example scheme, those steps might specify that the parameter "remains substantially constant."

As can now be appreciated, disclosed embodiments provide a device and method that can change the color temperature and brightness of lamps based on a TRIAC dimmer and used as carrier communication application. In embodiments, the input end of the dimmer is connected to the grid voltage, the load end of the dimmer is an LED lamp, and the lamp end has 2 channels and two light-emitting devices with different CCTs. One of the light-emitting devices is a high-CCT light-emitting device, and the other is a low-CCT light-emitting device. The white light composed of the two channels has a combined CCT and brightness. Its characteristics are: The dimmer has the function of a traditional thyristor dimmer and can send a programmed carrier signal at the same time. The lamp receives a carrier signal, and adjusts the distribution ratio of the two light-emitting devices according to the parameters of the carrier signal when the lamp is working. At the same time, when the dimmer is dimming, the lamp can be adjusted according to the specified CCT.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, circuits, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. An apparatus comprising:

a dimmer, configured and disposed to control a carrier signal, wherein the carrier signal is superimposed on an alternating current signal associated with a power source;

a user interface, configured and disposed to receive a specified correlated color temperature (CCT) value; and a modulator, the modulator configured and disposed to encode the specified CCT value on the carrier signal, wherein the apparatus is configured to provide power to:

a first light-emitting device that is configured to emit a first white light of a first correlated color temperature (CCT); and a second light-emitting device that is configured to emit a second white light of a second CCT that is lower than the first CCT, for the first white light to mix with the second white light to yield a combined white light having a combined-light CCT that corresponds to the specified CCT value; and wherein the first light-emitting device decreases in brightness as an input parameter value is decreased from a maximum value towards a minimum value and the second light-emitting device increases in brightness in an upper range, and wherein the second light-emitting device has a constant brightness in an upper portion of a lower range, and wherein the second light-emitting device has decreasing brightness in a lower portion of the lower range.

2. The apparatus of claim 1, wherein the dimmer comprises a phase-cut dimmer.

3. The apparatus of claim 1, wherein the user interface comprises a plurality of preset CCT value buttons.

4. The apparatus of claim 3, wherein the plurality of preset CCT value buttons includes a 2000K CCT button, a 3000K CCT button, a 4000K CCT button, and a 5000K CCT button.

5. The apparatus of claim 4, further comprising an ON-OFF control.

6. The apparatus of claim 4, further comprising a dimmer control.

7. The apparatus of claim 1, further comprising a wall-mount bracket.

8. An apparatus comprising:

a dimmer, configured and disposed to control a carrier signal, wherein the carrier signal comprises an alternating current signal;

a communication interface, configured and disposed to receive a specified CCT value;

a modulator, the modulator configured and disposed to encode the specified CCT value on the carrier signal, wherein the apparatus is configured to provide power to:

a first light-emitting device that is configured to emit a first white light of a first correlated color temperature (CCT); and a second light-emitting device that is configured to emit a second white light of a second CCT that is lower than the first CCT, for the first white light to mix with the second white light to yield a combined white light having a combined-light CCT that corresponds to the specified CCT value; and wherein the first light-emitting device decreases in brightness as an input parameter value is decreased from a maximum value towards a minimum value and the second light-emitting device increases in brightness in an upper range, and wherein the second light-emitting device has a constant brightness in an upper portion of a lower range, and wherein the second light-emitting device has decreasing brightness in a lower portion of the lower range.

9. The apparatus of claim 8, wherein the dimmer comprises a phase-cut dimmer.

10. The apparatus of claim 8, wherein the dimmer comprises a leading-edge phase-cut dimmer.

11. The apparatus of claim 8, wherein the dimmer comprises a trailing-edge phase-cut dimmer.

12. The apparatus of claim 8, wherein the communication interface comprises a radio frequency signal RF receiver.

13. The apparatus of claim 8, wherein the communication interface comprises a Bluetooth transceiver.

14. The apparatus of claim 8, wherein the communication interface comprises a Zigbee transceiver.

15. The apparatus of claim 8, wherein the communication interface comprises an infrared receiver.

16. An illumination system, comprising:

a controller;

a driver, the driver configured and disposed to receive input from the controller;

a first light-emitting device coupled to the driver;

a second light-emitting device coupled to the driver, wherein:

the first light-emitting device is configured to emit light having a CCT in a range of 4000K to 10000K;

the second light-emitting device is configured to emit light having a CCT in a range of 1500 to 4000K;

the controller comprising:

a dimmer, configured and disposed to control a carrier signal, wherein the carrier signal comprises an alternating current signal;

a communication interface, configured and disposed to receive a specified CCT value; and a modulator, the modulator configured and disposed to encode the specified CCT value on the carrier signal, and transmit the specified CCT value to the driver; and wherein the controller is configured to cause the first light-emitting device to decrease in brightness as an input parameter value is decreased from a maximum value towards a minimum value and cause the second light-emitting device to increase in brightness in an upper range, and wherein the second light-emitting device has a constant brightness in an upper portion of a lower range, and cause the second light-emitting device to decrease in brightness in a lower portion of the lower range.

17. The illumination system of claim 16, wherein the communication interface comprises a radio frequency signal RF receiver.

18. The illumination system of claim 16, wherein the communication interface comprises a Bluetooth transceiver.

19. The illumination system of claim 16, wherein the controller comprises a plurality of preset CCT value buttons that include 2000K CCT button, a 3000K CCT button, a 4000K CCT button, and a 5000K CCT button.

20. The illumination system of claim 16, wherein the controller further comprises a dimmer control.

* * * * *